United States Patent [19]

Rivas et al.

[11] Patent Number: 4,593,912

[45] Date of Patent: Jun. 10, 1986

[54] QUOIT THROWING GAME

[76] Inventors: Andrew Rivas; Robert Rivas, both of 1031 Trenton Ave., Forked River, N.J. 08731; James Pace, 7 McCooke Pl., Bayville, N.J. 08721; Timothy Cavanaugh, 978 Edinbergh Dr., Toms River, N.J. 08753

[21] Appl. No.: 707,800

[22] Filed: Mar. 4, 1985

[51] Int. Cl.[4] ..... A63B 67/06

[52] U.S. Cl. ..... 273/339

[58] Field of Search ..... 273/339, 336, 337, 338, 273/348, 424, 425, 427

[56] References Cited

U.S. PATENT DOCUMENTS 1,230,503 6/1917 Miller ..... 273/336

1,595,527 8/1926 Schacht ..... 273/339

*Primary Examiner*—William H. Grieb

*Attorney, Agent, or Firm*—Robert K. Youtie

[57] ABSTRACT

A quoit throwing game including three posts impaled at each end of a quoit pitching area or range; the posts being arrayed in a row longitudinally of the range with the intermediate post highest, so that the intermediate post most easily receives thereover a thrown quoit, the forward post receiving thereover a thrown quoit with some difficulty, and the rearward post receiving thereover a thrown quoit with greatest difficulty.

6 Claims, 6 Drawing Figures

QUOIT THROWING GAME

BACKGROUND OF THE INVENTION

The throwing of quoits, horseshoes and the like in games has been practiced for many years. Also, there has been provided in the prior art quoit or hoop pitching games with multiple pegs or posts of different heights. However, such games have been found unduly complex in construction and play, without the attention arresting attractiveness essential to long lasting use. Further, the prior art games have not provided a post having a generally flat rebounding surface, together with applicant's specific location, arrangement and elevation of posts to achieve substantial differences in difficulty required to engage a hoop or quoit over different posts, and different scoring associated with and corresponding to the differences in difficulty.

SUMMARY OF THE INVENTION

Accordingly, it is an important object of the present invention to provide a quoit throwing game which is relatively simple to manufacture, set up, use and score; being sufficiently simple for use by relatively young children while having a degree of sophistication and equipped to arrest the attention of adults for long periods of time; which is adapted for use in relatively limited space; and which is extremely safe to both the players and others in the immediate area.

Other objects of the present invention will become apparent upon reading the following specification and referring to the accompanying drawings, which form a material part of this disclosure.

The invention accordingly consists in the features of construction, combinations of elements, and arrangements of parts, which will be exemplified in the construction hereinafter described, and of which the scope will be indicated by the appended claims.

DESCRIPTION OF THE PREFERRED EMBODIMENTS

Figures 1, 2, 3, 4, 5, 6:
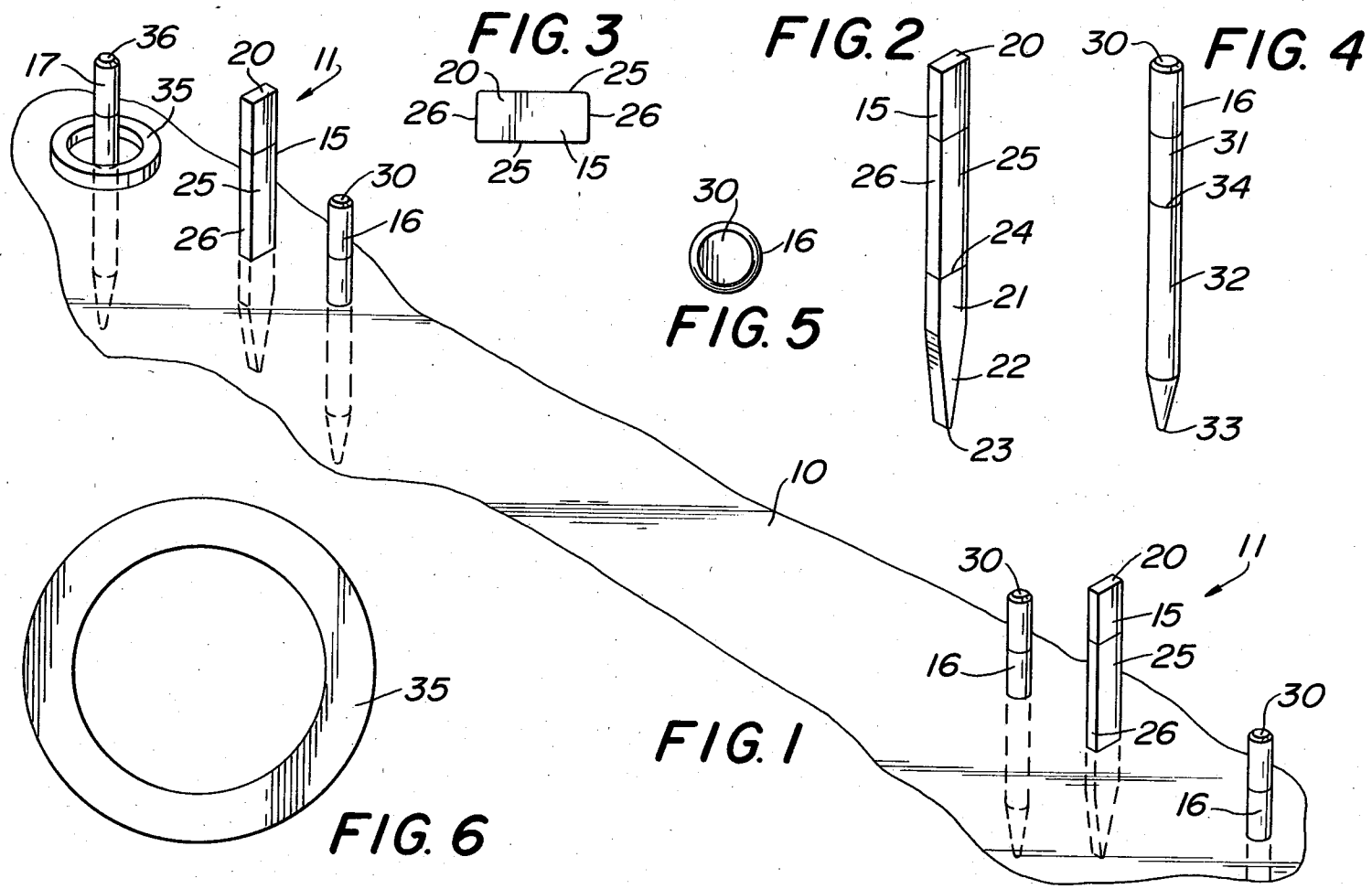
FIG. 1 is a top perspective view showing a quoit throwing game of the present invention in an operative condition of use.
FIG. 2 is a perspective view showing one type of post of the present invention.
FIG. 3 is a top end view of the post of FIG. 2.
FIG. 4 is a perspective view showing another type of post of the present invention.
FIG. 5 is a top end view of the post of FIG. 4.
FIG. 6 is a perspective view showing a quoit or hoop of the present invention.

Referring now more particularly to the drawings, and specifically to FIG. 1 thereof, a quoit pitching range or ground area is there generally designated 10, and may include a pair of target groups 11 at opposite ends of the range. The pair of target groups 11 may preferably be spaced apart approximately 12 feet, but may be spaced apart more or less depending upon the wishes of the players or the limitations of space.

Each target group includes an array of three pegs, pins or posts upstanding from the ground surface 10 in a series or row aligned generally longitudinally of the pitching range.

More specifically, each target group 11 includes an intermediate peg or post 15, a forward peg or post 16, and a rearward peg or post 17. The intermediate post 15 is located in spaced relation between and aligned in a row with its associated front and rear posts 16 and 17.

An intermediate post 15 is shown in greater detail in FIGS. 2 and 3. The post 15 is of generally rectangular cross section from its upper end 20 to an intermediate region 21, from which it tapers downwardly, as at 22 to a reduced lower end 23. Thus, the lower end region 23 may be somewhat pointed for ease of impaling in the ground or playing surface 10. A circumferential marking 24 may be provided intermediate the upper and lower ends 20 and 23, which may denote the limit of lower end impaling in the ground, so as to control the extent of post 15 upstanding above the ground.

As the rectangular cross-sectional configuration of post 15 is substantially constant from its upper end 20 to its demarcation line 24, the exposed upstanding upper portion of the post is seen to be defined between a pair of relatively wide, generally rectangular, substantially flat, parallel faces or sides 25, and a pair of relatively narrow, generally rectangular, substantially flat, parallel edges 26, each extending between the sides 25.

The front and rear posts 16 and 17 may be substantially identical, a front post 16 being shown in FIGS. 4 and 5. It will there be seen that the front post 16 is generally cylindrical including a generally circular upper end 30, being of constant circular cross section throughout an elongate body 31 to define its cylindrical configuration, and tapering at its lower region 32 to terminate at a reduced lower end 33. Here again, the lower tapering portion 32 facilitates impaling of the lower end 33 in the ground 10, with the post body portion 31 upstanding generally vertically from the ground. A circumferential marking or line 34 may be provided on the body 31 at a distance spaced from the upper post end 30 equal to the desired extent of the post 16 above the ground. Thus, the marking 34 may indicate the ground level of the impaled post. The rear posts 17 may be identical to the front posts 16, but may have the marking 34 at a different location for different post elevation, if desired.

As seen in FIG. 1, the entire game includes a pair of the intermediate posts 15, a pair of the forward posts 16, and a pair of the rearward posts 17. The intermediate posts 15 are of a lateral extent or width appreciably greater than the thickness or diameter of the front and rear posts 16 and 17, an intermediate post width of approximately twice the front and rear post diameter having been found satisfactory in use. For example, an intermediate post width of approximately $1\frac{3}{4}$ inches and an intermediate post thickness of approximately $\frac{3}{4}$ inches, together with an unimpaled length or elevation of intermediate post end 20 above the ground of about 9 inches has been found satisfactory. The front and rear posts 16 and 17 have been found satisfactory at about one inch diameter and approximately six inches of exposed length or upper end elevation.

In addition, a hoop or quoit is generally designated 35 in FIGS. 6 and has been found satisfactory in use having an outside diameter of about five inches, an inside diameter of about four inches, and a width of thickness of about $\frac{7}{8}$ inches. Of course, the above dimensions may be varied without departing from the spirit and scope of the present invention. A hoop of yieldable rubber has been found entirely satisfactory in play of the game, as well as entirely safe in use.

As seen in FIG. 1, an array of intermediate post 15, front post 16 and rear post 17 in a row, upstanding from the ground 10 provide a target group 11. The intermediate post 15 of each group has one flat side 25 facing longitudinally of the pitching range, toward the other target group 11. Spaced in front of the intermediate post 15 toward the other target group 11, is the forward post 16. In practice the forward or front post 16 is spaced in front of the intermediate post 15 a distance equal to the outside diameter of quoit 35, and the front post is centered with respect to the intermediate post, being directly in front of the latter, so as to be equally distant from the side edge 26. Also, the upper end 30 of front post 16 is at an elevation spaced below the upper end 20 of intermediate post 15. In practice, the upper front post end 30 may be spaced three inches below the upper intermediate post end 20.

Directly in back of the intermediate post 15, spaced equally from the side edges 26 of the intermediate post, may be the upstanding rear post 17. In practice, the rear post 17 may be two quoit diameters rearward of the intermediate post 15. Thus, the quoit 35 provides a spacing device for locating the front and rear post 16 and 17 with respect to the intermediate post 15. The rear post 17 may also have its upper end 36 spaced below the upper end 20 of the intermediate post, say about three inches below, or other spacing, as desired.

Each target group 11 may be substantially identical, and a desired number of quoits may be thrown in sequence, say two, which may be both thrown by one contestant, or each thrown by a different player.

As each target group includes an intermediate post 15 between the front and rear posts 16 and 17, and upstanding to an elevation beyond the front and rear posts, it will be readily apparent that a quoit tossed at a target group has a greater probability of engaging over an intermediate post than engaging over either of the front or rear posts. The intermediate post, in effect, is likely to intercept a quoit before it can fall to to lower elevation of the front and rear posts.

However, a thrown quoit may engage directly over the front post 16 without passing over or arched beyond the intermediate post 15. In addition, a quoit 35 may be rebounded or bounced off of the front flat surface or side 25 of the intermediate post 15 onto engagement about the front post 16. For these reasons, the intermediate post 15 may be relatively easy to engage over or ring with a thrown quoit, thrown from the opposite target group, some twelve feet away. Also, the front post 16 may be somewhat more difficult to engage over or ring with a similarly thrown quoit.

The rear post 17 may only be engaged over or ringed with a thrown quoit by arching the trajectory of thrown quoit over and passed beyond the intermediate post 15 for direct circumposition about or ringing on the rear post. Quoit ringing or engagement over the rear post 17 is therefore relatively difficult.

For this reason, the unique structure described hereinbefore has been found highly advantageous when employed with scoring of minus one (−1) for ringing the intermediate post, plus one (+1) for ringing the front post, and plus two (+2) for ringing the rear post. In this manner a lively and exciting game results by requiring the winner to first reach a specified total number, say five (5). Of course, other scoring may be employed, say for children, if desired.

Optionally the players may throw quoits or rings alternately, and a player whose quoit or ring tops that of another player may obtain the positive or negative points, or positive or negative bonus points, if desired. Also, it may be preferred to limit the ring tossing to rotation about a ring diameter, or about a ring axis, or neither, as preferred.

From the foregoing it is seen that the present invention provides a game of the quoit throwing type which may be played by persons of all ages, provides excitement while developing coordination, is entirely safe for use in crowded areas, and otherwise fully accomplishes its intended objects.

Although the present invention has been described in some detail by way of illustration and example for purposes of clarity of understanding, it is understood that certain changes and modifications may be made within the spirit of the invention.

What is claimed is:

1. A quoit throwing game comprising an intermediate post having at least one flat side facing forwardly when said intermediate post is impaled in a ground surface, said intermediate post being sized and located to easily receive over its upper end a thrown quoit, a forward post for location in front of said intermeidate post upstanding from the ground surface to an elevation less than that of said intermediate post, said forward post being sized and located to receive with some difficulty a thrown quoit directly over its upper end or rebounded from said flat side of said intemediate post, a rearward post for location in back of said intermediate post upstanding from the ground surface to an elevation less than that of said intermediate post, said rearward post being located and sized to receive with greater difficulty a thrown quoit directly over its upper end and passing over said intermediate post, and markings on said posts to indicate the length thereof impaled in the ground and determine said elevations.

2. A quoit throwing game according to claim 1, said intermediate post being wider than said front post to enhance use of said intermediate post for said rebounding.

3. A quoit throwing game according to claim 1, said imtermediate post having a side opposite to said one side generally flat and parallel to said one side, for impaling with either side forward.

4. A quoit throwing game according to claim 1, said forward and rearward posts being generally cylindrical and of a diameter less than the lateral dimension of said one side of said intermediate post.

5. A quoit throwing game according to claim 4, said intermediate post having a side opposite to said one side generally flat and parallel to said one side, for impaling with either side forward.

6. A quoit throwing game according to claim 1, in combination with at least one generally annular quoit for throwing over said posts, said quoit defining a spacer for locating said forward post a distance in front of said intermediate post approximately one half the distance of said rearward post in back of said intermediate post.

* * * * *